US011460043B2

(12) United States Patent
Qin et al.

(10) Patent No.: US 11,460,043 B2
(45) Date of Patent: Oct. 4, 2022

(54) INTERNAL AND EXTERNAL DUAL-PURPOSE AIR PUMP, INFLATABLE PRODUCT AND LIFTING HANDLE DEVICE

(71) Applicant: MANASLU TECHNOLOGY (SHANGHAI) CO., LTD., Shanghai (CN)

(72) Inventors: Guangying Qin, Shanghai (CN); Xiaoling Tang, Shanghai (CN)

(73) Assignee: MANASLU TECHNOLOGY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 17/327,165

(22) Filed: May 21, 2021

(65) Prior Publication Data

US 2022/0136524 A1 May 5, 2022

(30) Foreign Application Priority Data

Nov. 3, 2020 (CN) ..... 202011213562.6
Nov. 3, 2020 (CN) ..... 202022514109.0

(51) Int. Cl.

| | |
|---|---|
| ***F04D 29/42*** | (2006.01) |
| ***F04D 29/00*** | (2006.01) |
| ***F04D 25/06*** | (2006.01) |
| ***F04D 17/16*** | (2006.01) |
| ***F04D 29/62*** | (2006.01) |
| ***F04D 29/08*** | (2006.01) |

(52) U.S. Cl.

CPC ..... *F04D 29/4213* (2013.01); *F04D 17/165* (2013.01); *F04D 25/0673* (2013.01); *F04D 29/005* (2013.01); *F04D 29/083* (2013.01); *F04D 29/4253* (2013.01); *F04D 29/624* (2013.01)

(58) Field of Classification Search

CPC ..... F04D 25/06; F04D 25/0673
See application file for complete search history.

(56) References Cited

U.S. PATENT DOCUMENTS

| | | | | |
|---|---|---|---|---|
| 7,381,129 | B2 * | 6/2008 | Avedon | F04D 29/542 416/247 R |
| 9,335,061 | B2 * | 5/2016 | Avedon | F04D 25/08 |
| 10,221,861 | B2 * | 3/2019 | Avedon | F24F 7/013 |

(Continued)

*Primary Examiner* — J. Todd Newton
*Assistant Examiner* — Brian O Peters
(74) *Attorney, Agent, or Firm* — IP & T Group LLP

(57) ABSTRACT

Provided are an internal and external dual-purpose air pump, an inflatable product and a lifting handle device; the internal and external dual-purpose air pump includes a machine core, including a housing having an accommodating chamber and an inflating device arranged in the accommodating chamber; the housing is provided with an air outlet and an air suction inlet respectively in the bottom and top ends, and the air outlet and the air suction inlet can both communicate with the accommodating chamber; and the housing is slidably connected with a buckling member, which can move relative to the housing, thereby the machine core is buckled into or detached from a product to be inflated through the buckling member; the inflating device works to send air flow out through the air outlet and/or suction air flow through the air suction inlet. The inflatable product includes the internal and external dual-purpose air pump.

16 Claims, 8 Drawing Sheets

(56) References Cited

U.S. PATENT DOCUMENTS

2003/0156941 A1* 8/2003 Tsai ..... F04D 29/4246
415/148
2021/0003120 A1* 1/2021 Huang ..... F04B 35/04

* cited by examiner

INTERNAL AND EXTERNAL DUAL-PURPOSE AIR PUMP, INFLATABLE PRODUCT AND LIFTING HANDLE DEVICE

CROSS-REFERENCE TO RELATED APPLICATIONS

This disclosure claims priority to Chinese Patent Application No. 202022514109.0 filed with the Chinese Patent Office on Nov. 3, 2020, entitled "Internal and External Dual-Purpose Air Pump and Inflatable Product", and claims priority to the Chinese Patent Application No. 202011213562.6 filed with the Chinese Patent Office on Nov. 3, 2020, entitled "Lifting Handle Device", which are incorporated herein by reference in their entirety.

TECHNICAL FIELD

The present disclosure relates to the technical field of inflatable equipment, in particular, to internal and external dual-purpose air pump (i.e., a dual-purpose air pump which can be disposed internally or externally), inflatable product and lifting handle device.

BACKGROUND ART

With the continuous and rapid economic development and the continuous improvement of living standard of residents, some enthusiasts of outdoor and indoor sports increasingly like to use inflatable products such as inflatable beds, inflatable sofas or inflatable pools. In common technology, an inflating pump is usually used to inflate the inflatable products.

At present, the inflating pumps used in the existing inflatable products in the market can only be used internally or externally, and the function is relatively single.

In addition, the inflating pump is generally mainly constituted by a machine core (or battery box). Moreover, in order to protect the machine core, the machine core can also be mounted in a body.

However, the inflating pump which is provided with a body in the prior art usually has a problem that the machine core cannot be taken out conveniently. In some technologies, the machine core is provided with a lifting handle thereon for lifting and pulling the machine core, but the function of the lifting handle is relatively single.

SUMMARY

The present disclosure provides an internal and external dual-purpose air pump and an inflatable product, which solves the technical problem in the prior art that the inflating pumps used in the inflatable products can only be used internally or externally and thus the function is relatively single.

In a first aspect, the present disclosure provides an internal and external dual-purpose air pump, which can comprise a machine core, wherein the machine core can comprise a housing that comprises an accommodating chamber and an inflating device arranged in the accommodating chamber;

the housing can be provided with an air outlet and an air suction inlet respectively in the bottom end and the top end, and the air outlet and the air suction inlet can both be in communication with the accommodating chamber; and the housing can be slidably connected with a buckling member, and the buckling member can move with respect to the housing so that the machine core is buckled into or detached from a product to be inflated through the buckling member; and the inflating device can work to send air flow out through the air outlet and/or suction air flow through the air suction inlet.

In an optional embodiment, the housing can comprise an upper housing and a lower housing, and the upper housing can be snap-fitted with the lower housing, and both of them form the accommodating chamber; and the air outlet can be provided in the bottom end of the lower housing, and the air suction inlet can be provided in the top end of the upper housing.

In an optional embodiment, the inflating device can comprise an electric motor and a fan blade which is in transmission connection with the electric motor; the electric motor can be fixedly connected to the housing; and the electric motor can drive the fan blade to rotate to send the air flow out through the air outlet and/or suction the air flow through the air suction inlet.

In an optional embodiment, the electric motor can be fixed through a motor bracket, and the motor bracket can be connected between the upper housing and the lower housing; and the fan blade can be located on the upper housing and provided close to the air suction inlet.

In an optional embodiment, the inflating device can comprise a battery which supplies electric power to the electric motor.

In an optional embodiment, the battery can be a disposable battery; or the battery can be a rechargeable battery, and the inflating device can comprise a battery bracket and an electric interface, the battery bracket can be configured to accommodate the rechargeable battery and can be configured to electrically connect with the battery, and the electric interface can be provided in the outer wall of the housing and can be configured to electrically connect with the battery bracket.

The advantageous effects at least lie in the following:

the internal and external dual-purpose air pump provided by the present disclosure can be used directly when it is used for external purpose on the one hand, specifically, the inflating device can be activated, and the inflating device can work to send the air flow out through the air outlet, so as to achieve the inflating operation of the air pump; in addition, the inflating device can work to suction the air flow through the air suction inlet, so as to achieve the suction operation (or deflation operation of the product to be inflated) of the air pump; on the other hand, when it is used for internal purpose, as the housing is slidably connected with the buckling member, the buckling member can move with respect to the housing, so that the machine core snap-fits into the product to be inflated through the buckling member, at this moment, the internal and external dual-purpose air pump can be used internally for inflating the product to be inflated, and when the inflating is accomplished, the machine core can be detached from the product to be inflated through the buckling member.

Based on the above disclosure, it can be seen that the internal and external dual-purpose air pump can be used separately as an external air pump for inflating and suctioning, and can also be used as an internal air pump specifically for inflating the product to be inflated. The internal and external dual-purpose air pump provided by the present disclosure has the function that one pump has multiple purposes, and can be used conveniently.

In a second aspect, the present disclosure provides an inflatable product which can comprise a product capsule body and the internal and external dual-purpose air pump according to any one of the preceding embodiments; and the product capsule body is provided with an inflation/deflation port, and the inflation/deflation port is used for communicating with the air outlet or the air suction inlet.

In an optional embodiment, the inflation/deflation port of the product capsule body can be communicated with the air outlet or the air suction inlet through an air nozzle.

In an optional embodiment, in the case that the internal and external dual-purpose air pump is provided externally with respect to the product capsule body, a first inflation/deflation port can be communicated with the air outlet, so as to execute an inflating operation; or in the case that the internal and external dual-purpose air pump is provided externally with respect to the product capsule body, the first inflation/deflation port can be communicated with the air suction inlet, so as to execute a deflating operation.

On the other hand, the present disclosure provides an inflatable product, which can comprise a product capsule body and the internal and external dual-purpose air pump according to any one of the preceding embodiments, wherein the product capsule body is provided with a first inflation/deflation port therein; the first inflation/deflation port is configured to communicate with the air outlet or the air suction inlet; the product capsule body can comprise an airbag and a body press-fitted on the airbag, and an inflation port is disposed in the body; and the body can be provided with grooves in the end portion away from the inflation port.

In an optional embodiment, the machine core can be inserted into the body at the end away from the inflation port, so that the air outlet is positioned to face a second inflation/deflation port and the air suction inlet is positioned back to the second inflation/deflation port, and that the buckling member is snap-fitted into the grooves, and the air outlet communicates with the inflation port.

In an optional embodiment, the machine core can be inserted into the body at the end away from the inflation port, so that the air suction inlet is positioned to face the second inflation/deflation port and the air outlet is positioned back to the second inflation/deflation port, and that the air suction inlet communicates with the second inflation/deflation port.

In an optional embodiment, an air flow guiding component for guiding air flow can be provided between the air suction inlet and the second inflation/deflation port, and during working, the air flow guiding component can be inserted into the body.

In an optional embodiment, the body can be provided with a check valve for opening or closing the second inflation/deflation port, and the check valve can only be opened when it is exerted a force along a direction that the check valve is away from the internal chamber of the body.

In an optional embodiment, the air flow guiding component can be provided with a protruding portion at the end portion; when the air flow guiding component is inserted into the body, the protruding portion can push the check valve towards the direction away from the internal chamber of the body.

In an optional embodiment, the body can comprise a pushing member assembled on the check valve; when the air flow guiding component is inserted into the body, the air flow guiding component can press on the pushing member, and then push the check valve towards the direction away from the internal chamber of the body through the pushing member.

In an optional embodiment, the body can be provided with an upper cap at the end away from the inflation port, and a sealing structure can be provided between the upper cap and the body.

In an optional embodiment, the sealing structure can comprise a sealing groove and a sealing ring provided in the sealing groove; and the sealing groove can be provided in the body or the upper cap.

In an optional embodiment, a sealing gasket can be provided between the check valve and the second inflation/deflation port.

In an optional embodiment, the inflatable product comprises inflating beds, inflatable sofas, inflatable boats or inflatable pools.

The advantageous effects at least comprise the following:

the inflatable product provided by the present disclosure comprises the above-mentioned internal and external dual-purpose air pump, wherein the technical advantages and effects achieved by the inflatable product also comprise those achieved by the internal and external dual-purpose air pump, which will not be repeated herein.

On the other hand, the present disclosure provides a lifting handle device, which can comprise a body, a machine core and a buckling member;

the machine core can be disposed within the body;

the buckling member can comprise a lifting handle and rotary shafts fixedly disposed at the two sides of the lifting handle, and the rotary shafts can be hinged on the opposite sidewalls of the machine core; and the lifting handle can be in a retracted-released state and a lifted state; each rotary shaft can be inserted into the sidewall of the body at one end in the retracted-released state, and can be detached from the sidewall of the body in the lifted state.

In an optional embodiment, the machine core can comprise an upper housing, and the upper edge of the upper housing can extend outwardly to form the sidewall of the upper housing;

the sidewall of the upper housing can be disposed with shaft holes for the penetration of the rotary shafts; and the body can be provided with grooves for inserting the rotary shafts.

In an optional embodiment, the upper housing can be provided with a clamping structure, wherein the clamping structure can be used to clamp the lifting handle to the upper housing in the retracted-released state, so as to exert an axial force to the rotary shaft so that it can be inserted into the groove.

In an optional embodiment, the clamping structure can comprise a clamping rib, wherein the clamping rib can be located at the inner side of the sidewall of the upper housing and keeps a gap with the inner side of the sidewall of the upper housing; and the clamping rib can be used to clamp the lifting handle tightly between the clamping rib and the sidewall of the upper housing in the retracted-released state.

In an optional embodiment, the upper end of the upper housing can extend upwardly to form a first protruding wall; and the clamping rib can be located on the side of the first protruding wall towards the sidewall of the upper housing.

In an optional embodiment, the clamping rib and the first protruding wall can be formed to be an integrated construction.

In an optional embodiment, the lifting handle can be fixedly connected to the central part of the rotary shaft, and partition the rotary shaft into a first shaft section and a second shaft section; and the first shaft section can be arranged close to the groove, so as to form a buckling structure to be inserted into the sidewall of the body.

In an optional embodiment, the lifting handle can be a "U-shaped" lifting handle, and the rotary shaft can be a cylinder shaft.

In an optional embodiment, the lifting handle and the rotary shaft can be formed to be an integrated construction.

In an optional embodiment, the body can be a tubular structure which may have an upper opening.

The advantageous effects at least comprise the following:

the present disclosure provides a lifting handle device, wherein the machine core is provided within the body, the buckling member comprises a lifting handle and rotary shafts; during specific use, when the lifting handle is in a retracted-released state, as each rotary shaft can be inserted into the sidewalls of the body at one end, the machine core can be secured relative to the body, and at this moment, the machine core cannot be lifted or pulled out to achieve the buckling function; when the lifting handle is in a lifted state, as each rotary shaft can be detached from the sidewall of the body at one end, the machine core can detach from the body, and at this moment, the machine core can be lifted and pulled out upwardly, and meanwhile the lifting handle also has the function of lifting and pulling as a lifting handle. Based on the above disclosure, it can be seen that the lifting handle of the lifting handle device provided by the present disclosure has double functions of lifting and pulling, and buckling, and thus the functions are diverse, and it is relatively convenient for users.

BRIEF DESCRIPTION OF DRAWINGS

In order to more clearly illustrate technical solutions of embodiments of the present disclosure or the technical solutions in the prior art, the accompanying drawings which need to be used in the description of the embodiments or the prior art will be introduced briefly below, and it should be understood that the accompanying drawings below merely show some embodiments of the present disclosure, and those ordinarily skilled in the art still could obtain other relevant drawings according to these accompanying drawings without using any inventive effort.

Figure 1:
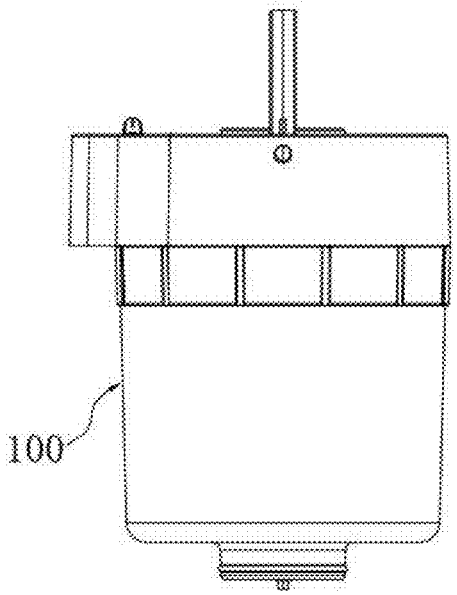
FIG. 1 is a schematic view of the structure of the machine core provided in the embodiment of the present disclosure.

Reference signs:

100—housing; 110—upper housing; 101—sidewall of the upper housing; 120—lower housing; 111—air suction inlet; 121—air outlet; 112—clamping rib; 113—first protruding wall;

200—buckling member; 210—lifting handle; 220—rotary shaft; 221—first shaft section; 222—second shaft section;

310—electric motor; 320—fan blade; 330—motor bracket; 340—battery; 350—circuit board; 360—electrical interface;

400—body; 410—inflation/deflation port; 411—check valve; 412—sealing gasket; 401—groove; 413—pushing member

500—upper cap;

600—sealing ring;

700—air suction nozzle; 701—protruding portion; 702—flange portion;

800—safety screen.

DETAILED DESCRIPTION OF EMBODIMENTS

In order to make objects, technical solutions and advantages of the embodiments of the present disclosure clearer, the technical solutions in the embodiments of the present disclosure will be described clearly and completely below in conjunction with accompanying drawings in the embodiments of the present disclosure. Obviously, the described embodiments are only a part of the embodiments of the present disclosure instead of all the embodiments. Usually, the assemblies of the embodiments of the present disclosure described and illustrated in the accompanying drawings herein can be arranged and designed through different arrangements.

Therefore, the detailed descriptions of the embodiments of the present disclosure provided in the accompanying drawings below are not intended to limit the protection scope of the present disclosure, but merely represent the selected embodiments of the present disclosure. Based on the embodiments of the present disclosure, any other embodiments obtained by those ordinarily skilled in the art without using any inventive efforts should be covered within the scope of protection of the present disclosure.

It should be noted that the same reference signs and letters in the following accompanying drawings indicate the same terms, and therefore, as along as a term is defined in a figure, it need not be further defined or explained in the figures thereafter.

In the description of the present disclosure, it should be noted that the orientation or position relations indicated by the terms "center", "upper", "lower", "left", "right", "vertical", "horizontal", "inner", "outside" and the like are based on the orientation or position relations shown in the accompanying drawings, or the orientation or position relations commonly arranged when the product according to the present disclosure is used, and they are just intended to conveniently describe the present disclosure and simplify the description, and are not intended to indicate or imply that the devices or elements as indicated should have specific orientations or should be configured and operated in specific orientations, and then they should not be construed as limitations to the present disclosure. In addition, the terms "first", "second", "third" and the like are only intended for differentiated descriptions and shall not be construed to indicate or imply relative importance.

In addition, the terms "horizontal", "vertical" and the like do not mean that the members should be horizontal or overhang absolutely, but they can be slightly inclined. For example, the term "horizontal" merely indicates that the direction is more "horizontal" with respect to the term "vertical", but it does not mean that the structure should be absolutely horizontal, while it may be slightly inclined.

In the description of the present disclosure, it should also be noted that, unless otherwise clearly specified and defined, terms "provide", "mount" "connect with each other" and "connect" should be understood in a broad sense, for example, they can be a fixed connection, a detachable connection, or an integral connection; they can be a mechanical connection or an electrical connection; they can be a direct connection or an indirect connection through an intermediate medium, and can be the internal communication between two elements. For a person skilled in the art, they may understand the specific meanings of the above-mentioned terms in the present disclosure according to specific circumstances.

The embodiments of the present disclosure will be described in details below in conjunction with the accompanying drawings. In the case of no conflict, the following embodiments and the features in the following embodiments can be combined with each other.

Figure 2:
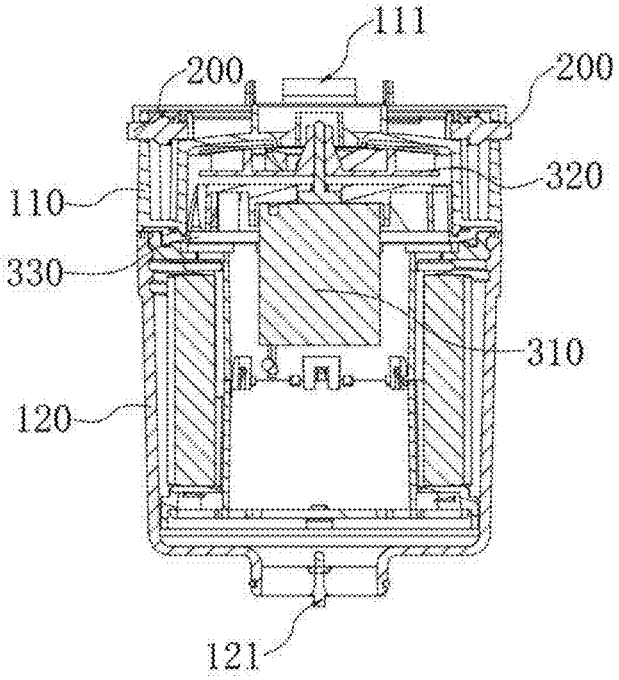
FIG. 2 is a section view of the machine core as shown in FIG. 1.

The present embodiment provides an internal and external dual-purpose air pump, as shown in FIGS. 1 and 2, the internal and external dual-purpose air pump comprises a machine core, and the machine core comprises a housing 100 with an accommodating chamber and an inflating device provided within the accommodating chamber; the housing 100 is provided with an air outlet 121 and an air suction inlet 111 respectively in the bottom end and the top end, and the air outlet 121 and the air suction inlet 111 are both in communication with the accommodating chamber. The inflating device works to send the air flow out through the air outlet 121 and/or suction the air flow through the air suction inlet 111.

The air pump provided by the embodiment of the present disclosure can inflate or deflate a product to be inflated. In an exemplary embodiment, the product to be inflated can comprise a product capsule body, wherein the product capsule body can be provided with a first inflation/deflation port (not shown) which is used to communicate with the air outlet 121 or the air suction inlet 111 of the air pump. According to the exemplary embodiment, the air pump can be an internal and external dual-purpose air pump; on the one hand, the air pump can be used in an external purpose with respect to the product capsule body of the product to be inflated; on the other hand, the air pump can be used by being provided inside the airbag body of the product capsule body. It should be understood that in the present text the term "internal" comprises not only the case that the machine core is completely accommodated within the airbag body, but also the case that only a portion of the machine core is accommodated in the airbag body. In other words, the term "internal" should be understood that at least a portion of the air pump is accommodated in the airbag body of the product capsule body.

Firstly, the external use of the air pump provided by the embodiment of the present disclosure is described as follows.

According to the exemplary embodiment, when used externally, the air pump ca be used individually as an external air pump for inflation and suction. In an implementation method, the air pump can be used directly. For example, in an exemplary embodiment, in the case that the air pump is located outside the product capsule body of the product to be inflated, the air outlet 121 of the air pump can be directly connected to the first inflation/deflation port (not shown) of the product capsule body. In this case, the inflating device of the machine core can be activated, and the inflating device works so that the air flow is sent out through the air outlet 121 of the air pump and enters the product to be inflated via the first inflation/deflation port of the product capsule body, thereby achieving the inflating operation of the air pump (i.e., realizing the inflation for the product to be inflated by the air pump).

In addition, in another exemplary embodiment, in the case that the air pump is provided outside the product capsule body of the product to be inflated, the air suction inlet 111 of the air pump is directly connected to the first inflation/deflation port of the product capsule body of the product to be inflated. In this case, the inflating device of the machine core can be activated, and the inflating device works so that the air flow is suctioned from the product to be inflated via the first inflation/deflation port through the air suction inlet 111, so as to achieve the suctioning operation of the air pump (i.e., realizing the deflation operation for the product to be inflated).

According to the embodiment of the present disclosure, as shown in FIG. 2, in the external state, the first inflation/deflation port of the product capsule body communicates with the air outlet 121, which can achieve the inflation; or the first inflation/deflation port of the product capsule body communicates with the air suction inlet 111, which can achieve the air suction. According to the exemplary embodiment, the first inflation/deflation port of the product capsule body can be communicated with the air outlet 121 or the air suction inlet 111 through an air nozzle, to achieve the inflation and suction.

According to the exemplary embodiment of the present disclosure, an inflatable product is provided, and the inflatable product comprises a product capsule body and the above-mentioned air pump. In the exemplary embodiment, the air pump can be provided externally with respect to the product capsule body of the product to be inflated, and the first inflation/deflation port of the product capsule body can be communicated with the air outlet 121 of the air pump to achieve the inflating operation; or the first inflation/deflation port of the product capsule body can be communicated with the air suction inlet 111 of the air pump to achieve the suctioning operation.

Although the external use of the air pump provided by the embodiments of the present disclosure is described in details in the above, it can be understood that a person skilled in the art can make appropriate modification and change to the above embodiments without departing from the scope of the present disclosure. For example, the size, the material, the shape and the like of the air outlet 121 and the air suction inlet 111 of the air pump can be changed appropriately, and the connection method between the air pump and the first inflation/deflation port can also be modified appropriately.

For example, although the case is described above that the air outlet 121 or the air suction inlet 111 of the air pump is directly connected to the first inflation/deflation port of the product capsule body of the product to be inflated so as to inflate or deflate the product to be inflated, it can be understood that the protection scope of the present disclosure is not limited to this. For example, in another form of realization, any other component, for example, a flexible hose and the like, can be provided to lead the air flow from the air outlet 121 of the air pump to the first inflation/deflation port of the product capsule body of the product to be inflated so as to inflate the product to be inflated, or to lead the air flow from the first inflation/deflation port of the product capsule body of the product to be inflated to the air suction inlet 111 of the air pump so as to deflate the product to the inflated.

In addition, it can be understood that according to the embodiment of the present disclosure, the air outlet 121 or air suction inlet 111 of the air pump can be provided thereon with a component which is appropriate to associate with the first inflation/deflation port or any other component (for example, the flexible hose) for leading the air flow, for example, a buckling member and the like. Through the above method, accidental disengagement of the air pump can be prevented during work.

In addition, it can be understood that in the case of the external use, the specific material, shape and configuration of the product capsule body of the product to be inflated will not be restricted in any way, as long as the product capsule body is provided with the first inflation/deflation port which can be connected with the air outlet 121 and the air suction inlet 111 of the air pump according to the present disclosure.

It should be understood that the above described embodiment and its variations, and any other modification without departing from the spirit of the present disclosure shall be deemed falling into the protection scope of the present disclosure.

Next, the internal use of the air pump provided in the embodiment of the present disclosure will be described.

Here, in order to achieve convenient understanding, the configuration of the product capsule body for the internal use of the air pump will be firstly described.

It should be understood that the configuration of the product capsule body for the internal use of the air pump may be different from the abovementioned product capsule body for the external use of the air pump. For example, the product to be inflated can be provided with at least one of a first product capsule body and a second product capsule body, wherein the first product capsule body is configured to be connected with the air pump for the external purpose, while the second product capsule body is configured to be connected with the air pump for the internal purpose. As the air pump provided by the embodiment of the present disclosure is an internal and external dual-purpose air pump, the air pump of the present disclosure can be used to inflate and deflate the product to be inflated in any case.

Figure 3:
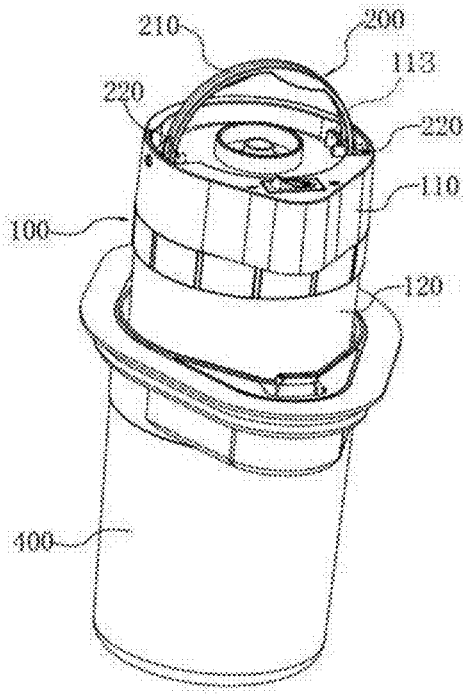
FIG. 3 is a schematic view of the structure of the internal and external dual-purpose air pump (lifting handle device) provided in the embodiment of the present disclosure, wherein the machine core is not completely placed inside the body.
Figure 4:
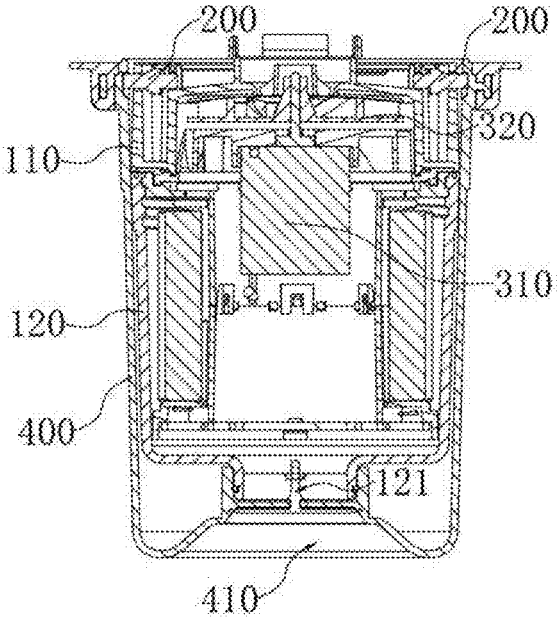
FIG. 4 is a section view of the internal and external dual-purpose air pump provided in the embodiment of the present disclosure, wherein the machine core is completely placed inside the body.

Referring to FIGS. 3 and 4, in the case that the air pump is used internally, the product capsule body of the product to be inflated comprises an airbag (not shown) and a body 400 press-fitted on the airbag, and a second inflation/deflation port 410 is disposed in the body 400, and the body 400 is provided with grooves in the end portion away from the second inflation/deflation port 410. According to the exemplary embodiment, the body 400 can adopt a tubular structure which has an upper opening.

Figure 5:
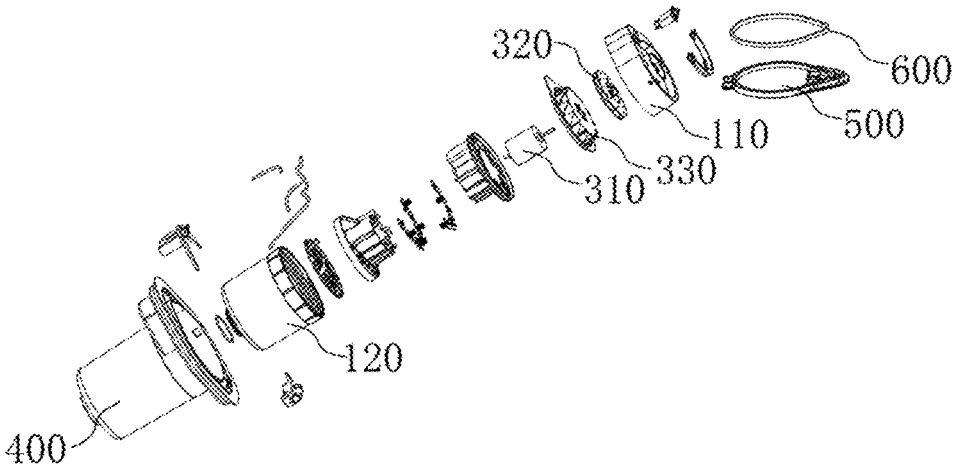
FIG. 5 is a split schematic view of the internal and external dual-purpose air pump as shown in FIG. 3.

As shown in FIG. 5, the body 400 is provided with an upper cap 500 at the end away from the inflation/deflation port 410. According to the exemplary embodiment, a sealing structure is provided between the upper cap 500 and the body 400, which has the function of sealing and waterproofing. For example, the sealing structure can comprise a sealing groove which is provided in one of the body 400 and the upper cap 500 and a sealing ring 600 provided in the sealing groove. In this way, the sealing between the upper cap 500 and the body 400 is achieved.

Figure 6:
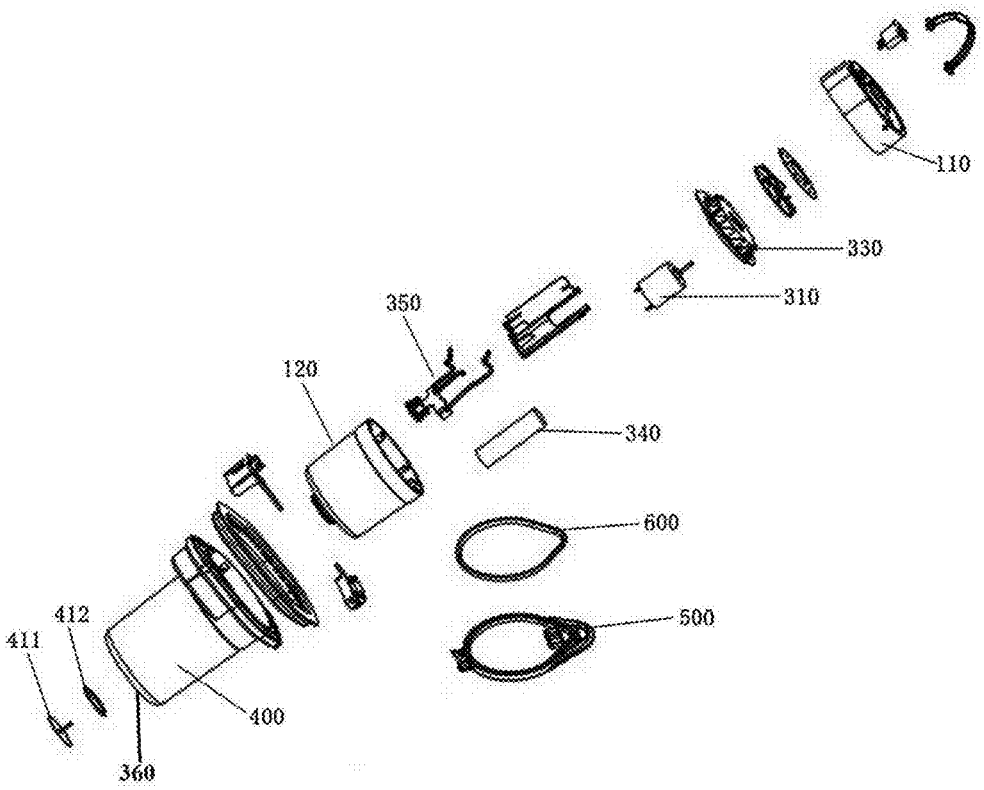
FIG. 6 is a split schematic view of the internal and external dual-purpose air pump according to another embodiment.

In addition, as shown in FIG. 6, according to the exemplary embodiment, the body 400 can be provided with a check valve 411 for opening or closing the second inflation/deflation port 410. When the check valve 411 is opened, the second inflation/deflation port 410 opens, and at this moment, the air flow can flow through the second inflation/deflation port 410; when the check valve 411 is closed, the second inflation/deflation port 410 will be closed, at this moment, the air flow cannot flow through the second inflation/deflation port 410. In the above, the check valve 411 can be only opened when it is exerted a force along a direction that the check valve 411 is away from the internal chamber of the body 400.

It can be understood that, according to the exemplary embodiment, the body 400 may be provided with a reset member, for example, a spring, for keeping the check valve 411 in a closed state. In this way, the second inflation/deflation port 410 is usually in a closed state, so as to prevent water or pollutant from entering the body 400.

It can further be understood that the air flow flowing inside the inflating device can exert a force to the check valve 411 along the direction that the check valve 411 is away from the internal chamber of the body 400 when the inflating operation of the air pump is performed, so that the second inflation/deflation port 410 can be opened.

According to the exemplary embodiment, as shown in FIG. 6, a sealing gasket 412 can also be provided between the check valve 411 and the second inflation/deflation port 410, for example, an O-shaped ring, so as to apply sealing between the check valve and the second inflation/deflation port 410.

According to the exemplary embodiment, the body 400 can be provided with both the sealing ring 600 and the sealing gasket 412, so as to seal both the opposite sides of the body 400 at the same time, i.e., providing a double sealing.

Figure 7:
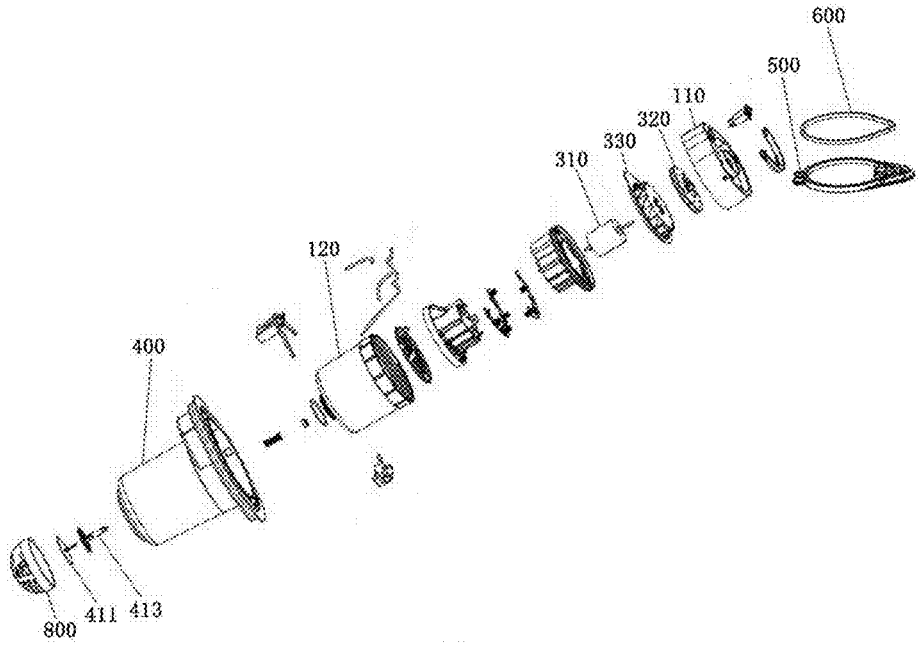
FIG. 7 is a split schematic view of the internal and external dual-purpose air pump according to yet another embodiment.

In addition, according to the exemplary embodiment, as shown in FIG. 7, the body 400 can also be provided with a safety screen 800, and the safety screen 800 is used to seal around the check valve 411 and the second inflation/deflation port 410, so as to protect the check valve 411 and the second inflation/deflation port 410 from contamination by foreign matters such as dust.

It should be understood that the details of the product capsule body described above are not restricted, and based on the embodiments of the present disclosure, a person skilled in the art could conceive of variations, and all such variations shall be deemed falling into the protection scope of the present disclosure.

Next, the case will be described below that the air pump provided by the embodiment of the present disclosure inflates the airbag of the product capsule body when the air pump is placed inside the product capsule body of the product to be inflated.

In the present text, for the purpose of convenient description, the end of the machine core provided with the air suction inlet 111 is referred to as the top end, and the end of the machine core provided with the air outlet 121 is referred to as the bottom end. It should be understood that the terms "top end" and "bottom end" do not limit the actual orientation of the use of the machine core, and during the work, the top end (i.e., the end provided with the air suction inlet 111) of the machine core can also face downwardly, while the bottom end (the end provided with the air outlet 121) of the machine core can also face upwardly.

According to the exemplary embodiment of the present disclosure, the machine core can be inserted into the body 400 at the end away from the second inflation/deflation port 410, and the air outlet 121 can be made to communicate with the inflation/deflation port 410, thereby achieving the inflating operation. In the exemplary embodiment, the machine core can be inserted into the body 400 in a way that the air outlet 121 faces the second inflation/deflation port 410 of the body 400. In this case, according to the exemplary embodiment, the machine core of the air pump can be completely accommodated in the body 400, and the air outlet 121 communicates with the second inflation/deflation port 410 of the body 400, and thus the inflating operation of the air pump can be achieved. It can be understood that in this case, the air suction inlet 111 is located at the top end of the machine core and located back to the second inflation/deflation port 410 of the body 400.

The connection between the machine core and the body 400 in such circumstance (i.e., when the machine core is inserted into the body 400 in a way that the air outlet 121 of the air pump faces the second inflation/deflation port 410 of the body 400) will be described hereinafter in details.

Figure 8:
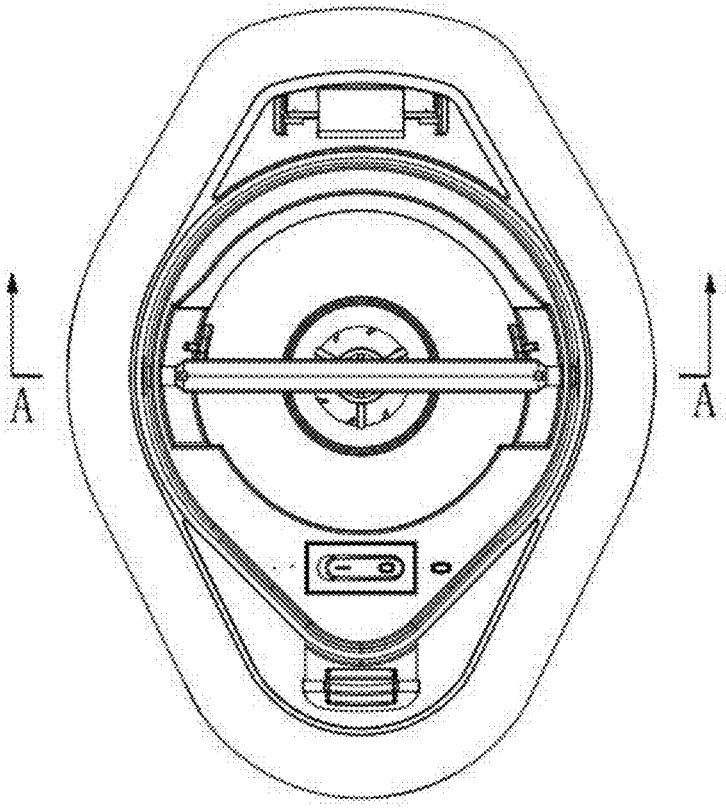
FIG. 8 is a top view of the lifting handle device as shown in FIG. 3.
Figure 9:
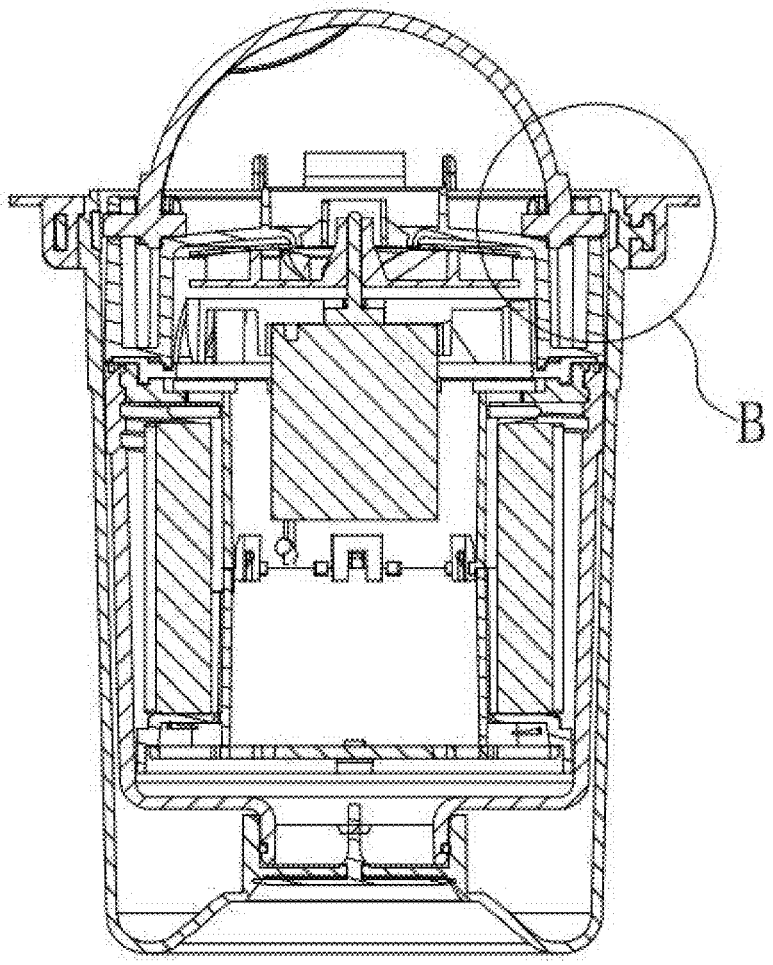
FIG. 9 is a section view along line A-A as shown in FIG. 8.
Figure 10:
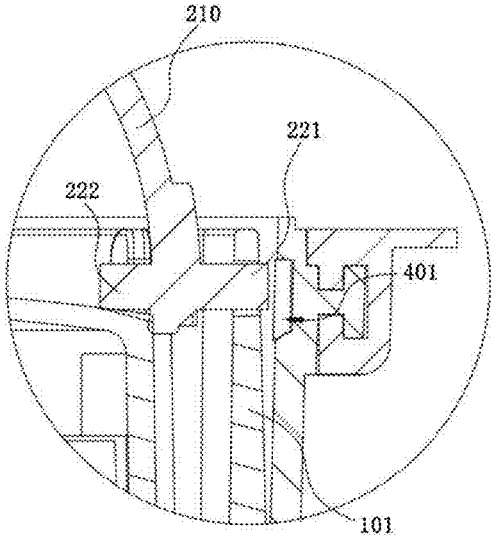
FIG. 10 is a partially enlarged schematic view of B as shown in FIG. 9.

In the present embodiment, as shown in FIG. 2, according to the exemplary embodiment of the present disclosure, the housing 100 of the machine core comprises an upper housing 110 and a lower housing 120. Referring to FIGS. 8-10, the upper edge of the upper housing 110 extends outwardly to form a sidewall 101 of the upper housing; the sidewall 101 of the upper housing can be disposed with a shaft hole for the penetration of the rotary shaft 220; and the body 400 is provided with a groove 401 therein for the insertion of the rotary shaft 220.

In the above, when the air pump is placed by the method as shown in FIG. 3, the upper edge of the upper housing 110 extends upwardly to form the sidewall 101 of the upper housing, and the sidewall 101 of the upper housing can be a circular sidewall, or a section of the circular sidewall. To be brief, the sidewall 101 of the housing has a main function of making convenient the installation of the rotary shaft 220 and the storage of the lifting handle 210.

Figure 11:
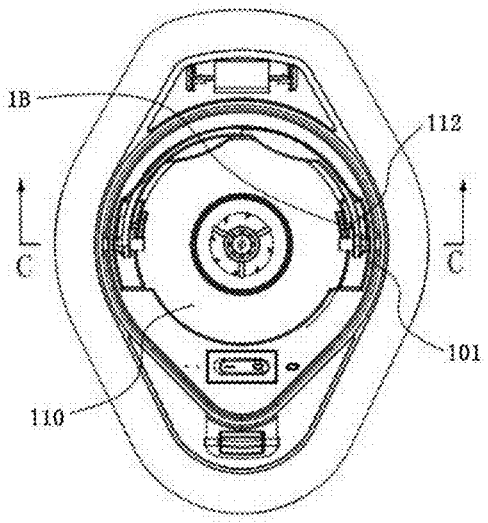
FIG. 11 is a top view of the lifting handle of the lifting handle device in a retracted-released state provided in the embodiment of the present disclosure.
Figure 12:
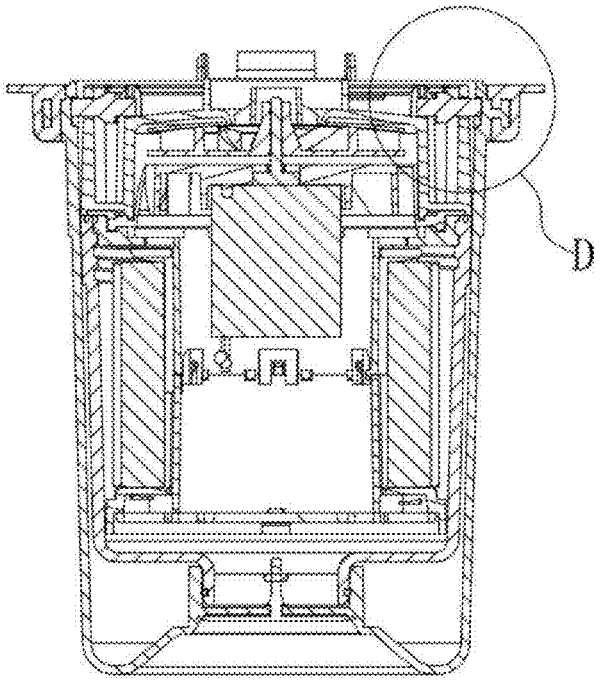
FIG. 12 is a section view along line C-C as shown in FIG. 11.
Figure 13:
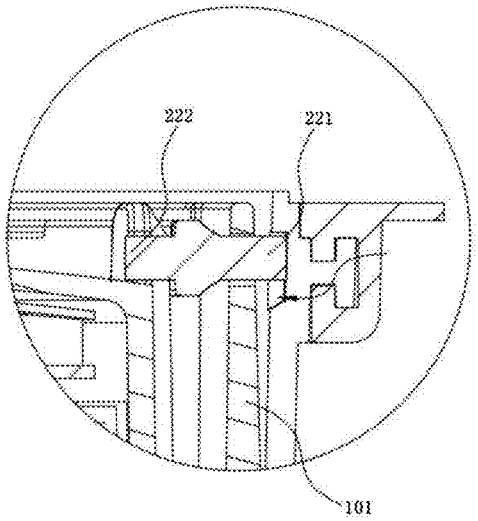
FIG. 13 is a partially enlarged schematic view of D as shown in FIG. 12.
Figure 14:
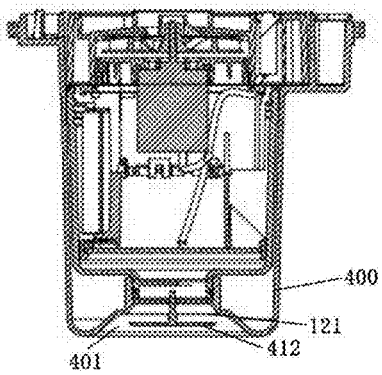
FIG. 14 is a schematic view of the inflating operation of the internal and external dual-purpose air pump when it is placed internally according to an embodiment.
Figure 15:
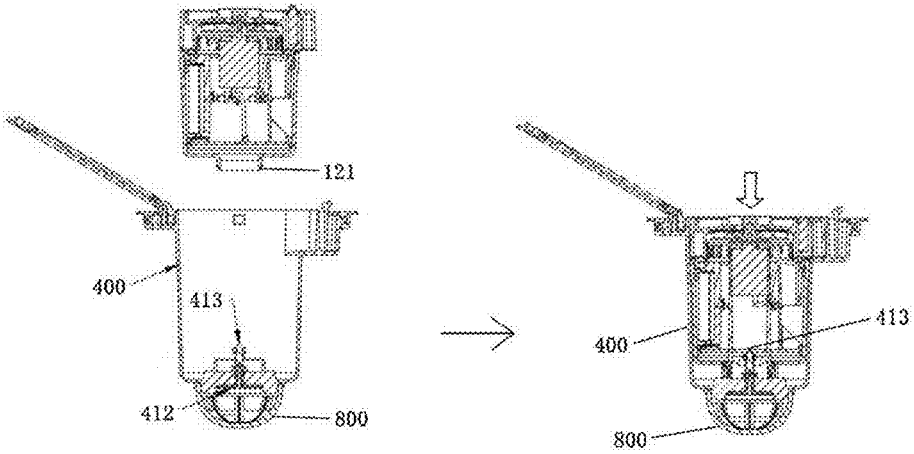
FIG. 15 is a schematic view of the inflating operation of the internal and external dual-purpose air pump when it is placed internally according to another embodiment.

As shown in FIGS. 11-13, the lifting handle 210 is in a retracted-released state; FIG. 13 shows that the rotary shaft 220 is inserted into the groove 401 at the end close to the body 400. In this case, the machine core can be inserted into the body 400 at the end away from the second inflation/deflation port 410, and the buckling member 200 can be made to buckle into the groove 401. In other words, at this moment, the machine core is fixed with respect to the body 400 so that the machine core cannot be detached from the body 400.

According to the exemplary embodiment of the present disclosure, the upper housing 110 can be provided with a clamping structure, and the clamping structure can be used to clamp the lifting handle 210 to the upper housing 210 when the lifting handle 210 is in the retracted-released state, so as to exert an axial force to the rotary shaft 220 so that it can be inserted into the groove 401. When lifted and pulled upwardly, the lifting handle 210 is detached from the clamping structure, and at this moment, the rotary shaft 220 is no longer subjected to the axial force by which the rotary shaft 220 can be inserted into the groove 401, that is, it can detach from the groove 401. For example, FIG. 10 shows that the end of the rotary shaft 220 close to the body 400 is detached from the groove 410, and in this state, the machine core can be pulled out of the body 400 by lifting and pulling the lifting handle 210 upwardly.

In the embodiment of the present disclosure, as shown in FIG. 11, the upper housing 110 is provided with a clamping rib 112, the clamping rib 112 is located at the inner side of the sidewall 101 of the upper housing and keeps a gap with the inner side of the sidewall 101 of the upper housing; and the clamping rib 112 is used to clamp the lifting handle 210 tightly between the clamping rib 112 and the sidewall 101 of the upper housing in the retracted-released state. In this way, when the lifting handle 210 is in the retracted-released state, the clamping rib 112 has a function of fixing the lifting handle 210 and can prevent the lifting handle 210 from moving with respect to the body 400 in such a state; meanwhile, the cooperation between the clamping rib 112 and the upper housing 110 further has a function of storing the lifting handle 210.

According to the exemplary embodiment, the upper end face of the upper housing 110 extends upwardly to form a first protruding wall 113; the clamping rib 112 can be located at the side of the first protruding wall 113 towards the sidewall 101 of the upper housing. Optionally, the clamping rib 112 and the first protruding wall 113 can be formed to be an integrated construction.

According to the exemplary embodiment of the present disclosure, as shown in FIG. 10 or 13, the lifting handle 210 is fixedly connected to the central part of the rotary shaft 220, and partitions the rotary shaft 220 into a first shaft section 221 and a second shaft section 222; and the first shaft section 221 is arranged close to the groove 401, so as to form a buckling structure for inserting the sidewall of the body 400.

In the embodiment, the lifting handle 210 adopts a "U-shaped" lifting handle, and the rotary shaft 220 adopts a cylinder shaft. It should be explained that the "U-shaped" or the approximately "U-shaped" lifting handles fall into protection scope of the present disclosure. In addition, it should be understood that the shapes of the lifting handle 210 and the rotary shaft 220 are not limited to this, for example, the lifting handle 210 and the rotary 220 can adopt other shapes, such as the square shape.

Optionally, the lifting handle 210 and the rotary shaft 220 can be formed to be an integrated configuration, and this arrangement makes processing convenient and relatively saves processing procedures.

According to the embodiment of the present disclosure, a lifting handle device is provided, wherein the machine core is provided within the body 400, the buckling member 200 comprises a lifting handle 210 and a rotary shaft 220, and in the specific process of use, when the lifting handle 210 is in a retracted-released state, as each rotary shaft 220 can be inserted into the sidewall of the body 400 at one end, the machine core can be fixed relative to the body 400, and at this moment, the machine core cannot be pulled out, and thus the buckling function is achieved; when the lifting handle 210 is in a lifted state, as each rotary shaft 220 can be detached from the sidewall of the body 400 at one end, the machine core can be detached from the body 400, and at this moment, the machine core can be lifted and pulled out upwardly, meanwhile the lifting handle 210 also has the function of lifting and pulling.

According to the lifting handle device provided by the exemplary embodiment of the present disclosure, the lifting handle 210 has double functions of lifting and pulling and buckling, and thus the functions are relatively diverse, which is relatively convenient for users in use. In addition, the lifting handle device also has the advantages of small space occupation, stable structure, low cost and the like.

According to the embodiment of the present disclosure, as shown in FIG. 3, the buckling member 200 comprises a lifting handle 210 and a rotary shaft 220 fixedly disposed at the two sides of the lifting handle 210, and the rotary shaft 220 is hinged on the opposite sidewalls of the upper housing 110; and the lifting handle 210 comprises a retracted-released state and a lifted state; each rotary shaft 220 can be inserted into or detached from the body 400 at one end respectively in the retracted-released state and in the lifted state. In specific use, when the lifting handle 210 is in a retracted-released state, as each rotary shaft 220 can be inserted into the groove of the body 400 at one end, the machine core can be fixed with respect to the body 400, and at this moment, the machine core cannot be lifted or pulled out, and thus the buckling function can be achieved; when the lifting handle 210 is in a lifted state, as each rotary shaft 220 can be detached from the body 400 at one end, the machine core can detach from the body 400, and at this moment, the machine core can be lifted and pulled out upwardly.

According to the exemplary embodiment, the housing 100 can be slidably connected with a buckling member 200 thereon, and the buckling member 200 can move with respect to the housing 100, so that the machine core is buckled into or detached from the product to be inflated through the buckling member 200. As the housing 100 is slidably connected with the buckling member 200, and the buckling member 200 can move with respect to the housing 100, the machine core can be buckled into the product to be inflated through the buckling member 200, and at this moment, the air pump can be used internally to inflate the product to be inflated, and when the inflation is accomplished, the machine core can detach from the product to be inflated through the buckling member 200.

The above-mentioned are description for the inflating operation of the air pump when the air pump is provided inside the air pump and the connection between the machine core and the body 400. Next, the case that the air pump provided by the embodiment of the present disclosure deflates the airbag when it is provided inside the airbag of the capsule body 400 will be described as follows.

Figure 16:
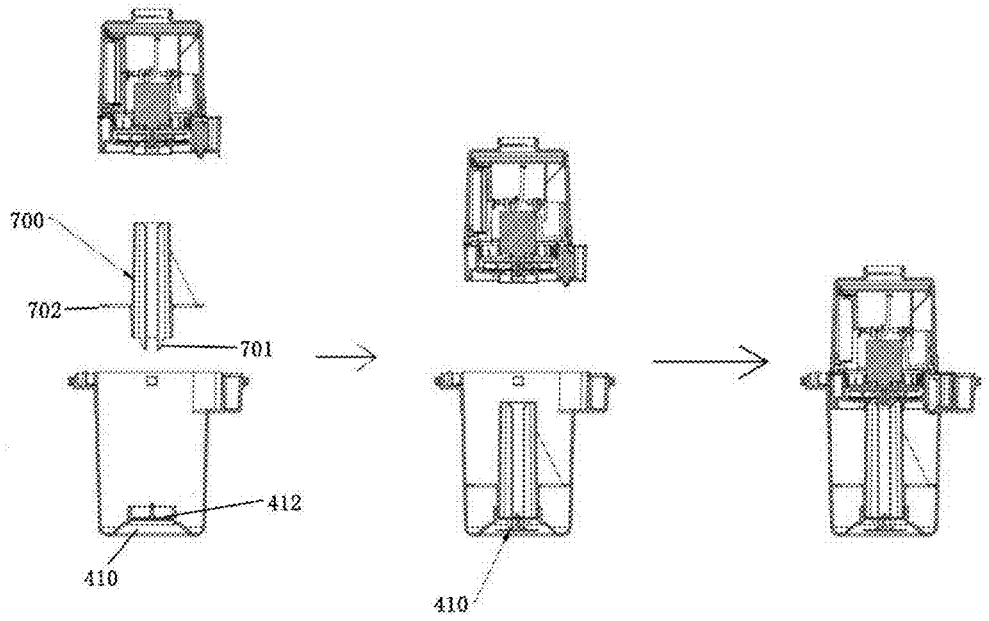
FIG. 16 is a schematic view of the deflating operation of the internal and external dual-purpose air pump when it is placed internally according to an embodiment.
Figure 17:
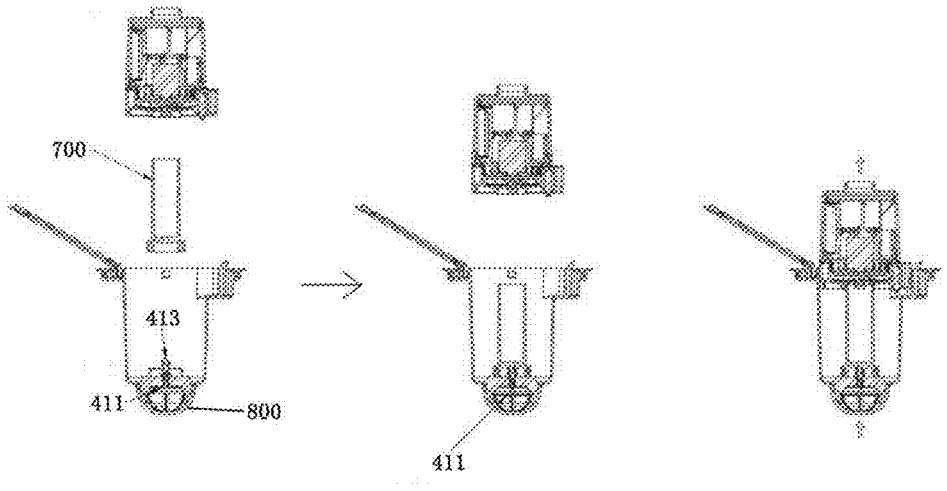
FIG. 17 is a schematic view of the deflating operation of the internal and external dual-purpose air pump when it is placed internally according to another embodiment.

According to the exemplary embodiment, the machine core can be inserted into the body 400 at the end away from the second inflation/deflation port 410. Referring to FIGS. 16 and 17, they illustrate that the machine core is inserted into the end of the body 400 away from the second inflation/deflation port 410 and the air suction inlet 111 communicates with the second inflation/deflation port 410 of the body 400, and thus the deflating operation to the body 400 through the air pump is achieved. In the exemplary embodiment, the machine core can be inserted into the body 400 in a way that the air suction inlet 111 faces the second inflation/deflation port 410 of the body 400. In this case, the air suction inlet 111 is positioned to face the second inflation/deflation port 410 and the air outlet 121 is positioned back to the second inflation/deflation port 410. As shown in FIGS. 14-17, in the case of internal use, relative to the deflating operation, the machine core is turned upside down during the inflating operation, that is, it is rotated by 180 degrees. In this case, only the top end (i.e., the end provided with the air suction inlet 111) of the machine core is accommodated in the body 400 and the bottom end (i.e., the end provided with the air outlet 121) of the machine core protrudes outside the body 400.

It should be understood that in the present embodiment, referring to FIGS. 16 and 17, an air flow guiding component 700 for guiding air flow is provided between the air suction inlet 111 of the air pump and the second inflation/deflation port 410 of the body 400. The air flow guiding component 700 is for example an air suction nozzle.

According to the exemplary embodiment, the air flow guiding component 700 is firstly inserted into the body 400, and then the machine core is mounted on the body 400 and the air flow guiding component 700.

Referring to FIG. 17, in the exemplary embodiment, when the air flow guiding component 700 is inserted into the body 400, the air flow guiding component 700 can exert a force to the check valve 411 along the direction that the check valve 411 is away from the internal chamber of the body 400, so that the second inflation/deflation port 410 of the body 400 is opened. In this way, air flow can be suctioned from the second inflation/deflation port 410 of the body 400 through the air suction inlet 111 of the air pump via the air flow guiding component 700 (for example, a suction nozzle), so as to realize the deflating operation of the air pump.

It can be understood that the manner that the air flow guiding component 700 exerts the force to the check valve 411 is not limited, as long as the check valve 411 can be opened by the air flow guiding component 700.

In the exemplary embodiment, as shown in FIGS. 16 and 17, the air flow guiding component 700 can be an elongated member provided between the air suction inlet 111 of the air pump and the second inflation/deflation port 410 of the body 400.

In the exemplary embodiment as shown in FIG. 11, the air flow guiding component 700 can be provided with a protruding portion 701 at the end portion. When the air flow guiding component 700 is inserted into the body 400, the protruding portion 701 can push the check valve 411 towards the direction away from the internal chamber of the body 400, so that the second inflation/deflation port 410 is opened.

In the exemplary embodiment, the air flow guiding component 700 can be provided with a flange portion 702 which extends outwardly from the external wall of the air flow guiding component 700. When the air flow guiding component 700 is inserted into the body 400, the flange portion 702 can tightly abut the inner wall of the body 400, so as to firmly hold the air flow guiding component 700 in the body 400. In this way, it is possible to prevent vibration, accidental detachment or the like of the air flow guiding component 700 during the work.

In the exemplary embodiment as shown in FIG. 17, the body 400 can comprise a pushing member 413 assembled on the check valve 411; when the air flow guiding component 700 is inserted into the body 400, the air flow guiding component 700 will press on the pushing member 413, and thus push the check valve 411 through the pushing member 413 towards the direction away from the internal chamber of the body 400, so that the second inflation/deflation port 410 is opened.

According to the exemplary embodiment, the pushing member 413 can be mounted on the check valve 411, and when the air flow guiding component 700 is inserted into the body 400, the air flow guiding component 700 can be assembled on the pushing member 413 in a way of shape cooperation or friction cooperation, so that the air flow guiding component 700 is firmly kept within the body 400. In this way, it is possible to prevent vibration or accidental detachment or the like of the air flow guiding component 700 during the work.

It can be understood that in the embodiment, as the air flow guiding component 700 can be located through the pushing member 413, other elements (such as the flange portion 702) used to position the airflow guide member 700 in the body 400 will become unnecessary. In this way, the size of the airflow guiding component 700 can be reduced, and the packaging, subsequent transportation and the like of the airflow guiding component 700 can be facilitated.

It can be understood that according to the exemplary embodiment, the flange portion 702 may also be provided when the pushing member 413 is provided, which does not depart from the scope of the present disclosure.

It can be understood that the pushing member 413 as shown in FIG. 17 is only an example, and the arrangement of the pushing member 413 is not limited to this. For example, the pushing member 413 can also be an integral component formed at the end portion of the air flow guiding component 700, and when the air flow guiding component 700 is inserted into the body 400, the pushing member abuts the check valve 411 and pushes the check valve 411 towards the direction away from the internal chamber of the body 400. It should be understood that the variation manner does not depart from the scope of the present disclosure.

It should be understood that the details of the air flow guiding component 700 described above are not limited, and in the case of not departing from the protection scope of the present disclosure, a person skilled in the art could conceive of variations based on the specific embodiments disclosed in the text, and the variations shall be deemed falling into the protection scope of the present disclosure.

Based on the exemplary embodiments described above, it can be understood that the air pump provided by the exemplary embodiment of the present disclosure is an internal and external dual-purpose air pump, and the internal and external dual-purpose air pump can be used individually not only as an external air pump for inflation and suction, but also as an internal air pump for inflating and deflating special product to be inflated. The internal and external dual-purpose air pump provided by the present disclosure has the function of one pump with multiple purposes, and it is more convenient in use.

It should be explained that the internal and external dual-purpose air pump can inflate and suction air for the product to be inflated both in the external state and in the internal state. The specific structure of the air pump provided by the exemplary embodiment of the present disclosure will be described in details hereinafter.

Referring to FIG. 2, according to the exemplary embodiment, the housing 100 comprises an upper housing 110 and a lower housing 120, and the upper housing 110 is buckled with the lower housing 120, and both of them enclose the accommodating chamber; and the air outlet 121 is provided in the bottom end of the lower housing 120, and the air suction inlet 111 is provided in the top end of the upper housing 110, and this arrangement makes it convenient to mount the components located inside the housing 100, for example, the mounting of the inflating device; and specifically, the upper housing 110 can be mounted after the inflating device is mounted. It should be understood that the terms "bottom end" and "top end" do not define the actual working orientations, and are only intended for convenience in the description. During the use, the air outlet 121 may also face upwardly, while the air suction inlet 111 may also face downwardly.

Referring to FIG. 2 again, the inflating device comprises an electric motor 310 and a fan blade 320 which is in transmission connection with the electric motor 310; the electric motor 310 is fixedly connected to the housing 100; the electric motor 310 drives the fan blade 320 to rotate to send the air flow out through the air outlet 121 and/or suction the air flow through the air suction inlet 111. It can be understood that during the work, the air flow will flow through the electric motor 310 and then cool the motor 310 which generates heat during work. In this way, the durability of the motor can be improved and the life of the motor can be extended.

Specifically, referring to FIG. 2, according to the exemplary embodiment, during inflating the product to be inflated, the electric motor 310 drives the fan blade 320 to rotate clockwise and generate downward airflow, and the airflow pushes the air in the housing 100 to move towards the air outlet 121 and enters the product to be inflated through the air outlet 121; moreover, during deflating the product to be inflated, the electric motor 310 drives the fan blade 320 to rotate counterclockwise, so that the airflow inside the housing 100 moves outwardly to achieve the air release (deflation) of the product to be inflated.

According to the exemplary embodiment, the electric motor 310 is fixed through a motor bracket 330 and the motor bracket 330 is connected between the upper housing 110 and the lower housing 120. In the exemplary embodiment, the fan blade 320 is positioned on the upper housing 110 and close to the air suction inlet 111; and such arrangement makes it convenient to push the airflow to move downwardly to accomplish the inflation. Furthermore, it is convenient to make the air flow move reversely to achieve the suctioning.

In the exemplary embodiment, referring to FIG. 6, the inflating device can comprise a battery 340 which supplies electric power to the electric motor 310. According to the exemplary embodiment, the battery 340 can be a disposable single battery unit, or a battery pack including a plurality of battery units. It can be understood that the realizing method of the battery 340 is not limited to this. Preferably, the battery 340 can be a rechargeable battery. In this circumstance, as shown in FIG. 6, the inflating device can also comprise a circuit board 350 and an electric interface 360, wherein the circuit board 350 is configured to be electrically connected with the battery 340, and the electric interface 360 is provided on the outer wall of the housing 100 and can also be configured to be electrically connected with the circuit board 350. In the exemplary embodiment, the electric interface 360 can be a USB charging port. According to the exemplary embodiment, the electric interface 360 can be provided at the bottom wall of the housing 100. In the exemplary embodiment, the inflating device can also comprise a circuit board bracket.

It can be understood that the electric power supply method of the electric motor 310 is not limited to the above described disposable battery or the rechargeable battery. It can be understood that it is also possible to connect the inflating device directly to an electrical socket through a wire during the work to provide real-time power supply to the electric motor 310, which does not depart from the scope or idea of the present disclosure, and should also be deemed falling within the scope of the present disclosure.

According to the exemplary embodiment of the present disclosure, the inflatable product is not limited to inflatable beds, inflatable sofas, inflatable boats or inflatable pools.

Finally, it should be explained that the above embodiments are merely for describing the technical solutions of the present disclosure and not intended to limit the present disclosure; although the present disclosure is described in details by referring to the preceding embodiments, a person skilled in the art should understood that he or she can still make modifications to the technical solutions disclosed in the preceding embodiments, or make combinations or equivalent substitutions to a portion of or all of the technical features; however, the modifications, combinations or substitutions will not make the essence of the corresponding technical solutions go beyond the scope of the technical solutions of the respective embodiments of the present disclosure.

INDUSTRIAL APPLICABILITY

The present disclosure provides an internal and external dual-purpose air pump, an inflatable product and a lifting handle device, and relates to the technical field of inflating equipment. The internal and external dual-purpose air pump comprises a machine core, wherein the machine core comprises a housing that comprises an accommodating chamber and an inflating device arranged in the accommodating chamber; the housing is provided with an air outlet and an air suction inlet respectively in the bottom end and the top end, and the air outlet and the air suction inlet are both in communication with the accommodating chamber; and the housing is slidably connected with a buckling member, and the buckling member can move with respect to the housing so that the machine core is buckled into or detached from the product to be inflated through the buckling member; and the inflating device works to send the air flow out through the air outlet and/or suction the air flow through the air suction inlet. The inflatable product comprises the internal and external dual-purpose air pump. Through the internal and external dual-purpose air pump, the technical problem that the inflating air pump used by the inflatable product can only be used internally or externally and then the function of the product is relatively single is solved.

Furthermore, it can be understood that the internal and external dual-purpose air pump, the inflatable product and the lifting handle device of the present disclosure can be reproduced, and can be applied in a variety of industries. For example, the internal and external dual-purpose air pump, the inflatable product and the lifting handle device of the present disclosure can be used in any component which needs to be inflated.

What is claimed is:

1. A dual-purpose air pump which can be disposed internally or externally, comprising a machine core, wherein the machine core comprises a housing that comprises an accommodating chamber and an inflating device arranged in the accommodating chamber;

an air outlet and an air suction inlet are provided in a bottom end and a top end of the housing, respectively, and the air outlet and the air suction inlet both are in communication with the accommodating chamber; and the housing is slidably connected with a buckling member, and the buckling member is able to move with respect to the housing, so that the machine core is, through the buckling member, buckled into or detached from a product to be inflated; and the inflating device works to send air flow out through the air outlet and/or suction air flow through the air suction inlet.

2. The dual-purpose air pump which can be disposed internally or externally according to claim 1, wherein the housing comprises an upper housing and a lower housing, wherein the upper housing is snap-fitted with the lower housing, and both of them form the accommodating chamber; and the air outlet is provided in a bottom end of the lower housing, and the air suction inlet is provided in a top end of the upper housing.

3. The dual-purpose air pump which can be disposed internally or externally according to claim 2, wherein the inflating device comprises an electric motor and a fan blade which is in transmission connection with the electric motor, wherein the electric motor is fixedly connected to the housing; and the electric motor drives the fan blade to rotate, so as to send the air flow out through the air outlet and/or suction the air flow through the air suction inlet.

4. The dual-purpose air pump which can be disposed internally or externally according to claim 3, wherein the electric motor is fixed through a motor bracket, and the motor bracket is connected between the upper housing and the lower housing; and the fan blade is located on the upper housing and provided adjacent to the air suction inlet.

5. The dual-purpose air pump which can be disposed internally or externally according to claim 4, wherein the inflating device comprises a battery which supplies electric power to the electric motor, wherein the battery is a disposable battery; or the battery is a rechargeable battery, and the inflating device comprises a circuit board and an electric interface, wherein the circuit board is configured to be electrically connected with the battery, and the electric interface is provided on an outer wall of the housing and configured to be electrically connected with the circuit board.

6. The dual-purpose air pump which can be disposed internally or externally according to claim 3, wherein the inflating device comprises a battery which supplies electric power to the electric motor, wherein the battery is a disposable battery; or the battery is a rechargeable battery, and the inflating device comprises a circuit board and an electric interface, wherein the circuit board is configured to be electrically connected with the battery, and the electric interface is provided on an outer wall of the housing and configured to be electrically connected with the circuit board.

7. An inflatable product, comprising a product capsule body and the dual-purpose air pump which can be disposed internally or externally according to claim 1, wherein the product capsule body is provided with a first inflation/deflation port; the first inflation/deflation port is configured to communicate with the air outlet or the air suction inlet; the product capsule body comprises an airbag and a body press-fitted on the airbag, and the body is provided with a second inflation/deflation port; and the body is provided with grooves in an end portion away from the second inflation/deflation port.

8. The inflatable product according to claim 7, wherein the machine core is able to be inserted into the body at an end away from the second inflation/deflation port, so that the air outlet is positioned to face the second inflation/deflation port and the air suction inlet is positioned back to the second inflation/deflation port, and that the buckling member is snap-fitted into the grooves, and the air outlet communicates with the second inflation/deflation port.

9. The inflatable product according to claim 8, wherein an upper cap is provided at an end of the body away from the second inflation/deflation port, a sealing structure is provided between the upper cap and the body, wherein the sealing structure comprises a sealing groove and a sealing ring provided in the sealing groove; and the sealing groove is provided in the body or the upper cap.

10. The inflatable product according to claim 7, wherein the machine core is able to be inserted into the body at an end away from the second inflation/deflation port, so that the air suction inlet is positioned to face the second inflation/deflation port and the air outlet is positioned back to the second inflation/deflation port, and that the air suction inlet communicates with the second inflation/deflation port.

11. The inflatable product according to claim 10, wherein an air flow guiding component configured to guide air flow is provided between the air suction inlet and the second inflation/deflation port, and during working, the air flow guiding component is inserted into the body.

12. The inflatable product according to claim 11, wherein the body is provided with a check valve configured to open or close the second inflation/deflation port, and the check valve is opened only with a force exerted which is along a direction making the check valve away from an internal chamber of the body.

13. The inflatable product according to claim 12, wherein a protruding portion is provided at an end portion of the air flow guiding component, wherein when the air flow guiding component is inserted into the body, the protruding portion pushes the check valve towards the direction away from the internal chamber of the body.

14. The inflatable product according to claim 12, wherein a sealing gasket is provided between the check valve and the second inflation/deflation port.

15. The inflatable product according to claim 7, wherein an upper cap is provided at an end of the body away from the second inflation/deflation port, a sealing structure is provided between the upper cap and the body, wherein the sealing structure comprises a sealing groove and a sealing ring provided in the sealing groove; and the sealing groove is provided in the body or the upper cap.

16. The inflatable product according to claim 7, wherein the inflatable product comprises inflating beds, inflatable sofas, inflatable boats or inflatable pools.

* * * * *